United States Patent [19]

Wick

[11] 4,273,536

[45] Jun. 16, 1981

[54] GUN SIMULATOR SYSTEM

[75] Inventor: Ralph E. Wick, Las Vegas, Nev.

[73] Assignee: The United States of America as represented by the Secretary of the Air Force, Washington, D.C.

[21] Appl. No.: 115,844

[22] Filed: Jan. 28, 1980

[51] Int. Cl.[3] ..... F41F 27/00

[52] U.S. Cl. ..... 434/14; 434/21

[58] Field of Search ..... 35/25

[56] References Cited

U.S. PATENT DOCUMENTS

| | | | |
|---|---|---|---|
| 3,452,453 | 7/1969 | Ohlund | 35/25 |
| 3,813,795 | 6/1974 | Marshall et al. | 35/25 |
| 3,927,480 | 12/1975 | Robertsson | 35/25 |
| 3,955,292 | 5/1976 | Robertsson | 35/25 |
| 4,011,789 | 3/1977 | Breese et al. | 89/41 EA |

*Primary Examiner*—William H. Grieb

*Attorney, Agent, or Firm*—Donald J. Singer; Jacob N. Erlich

[57] ABSTRACT

A gun simulator system which is capable of safely simulating any airborne gun. The simulation takes into account not only aircraft approach angle but also preselected range and bullet trajectory. In so doing, the gun simulator system records hits both on the ground and in the aircraft for each pass. In addition, the simulator system is readily adaptable for use with already existing simulator programs.

7 Claims, 3 Drawing Figures

GUN SIMULATOR SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates generally to weapon simulators, and, more particularly to a gun simulator system which contains a laser and is readily adaptable for use in an aircraft. Additionally, the system is capable of incorporating trajectory as well as range information in order to provide a more accurate simulation.

In today's military environment it is necessary for combat air crew to maintain a high degree of combat effectiveness. To keep this fine edge of combat readiness, it is desirable to establish and maintain realistic training programs. Such training programs, in order to be effective, must promote participation by the combatants. For example, todays fighter pilot must develop skills that will not only allow him to successfully maneuver his weapon platform in an air-to-air engagement, but also to effectively identify and destroy assigned ground targets.

An effective means of training todays figher pilot outside of the classroom is the air-to-air and air-to-ground engagement simulation. Such simulation takes place at electronic warfare ranges which provide the pilot with as near perfect electronic simulation of surface-to-air and air-to-air combat engagements as it is possible, short of actual missile launch and active anti-aircraft gun fire. By providing the most realistic ground based threat signals available, it is possible to simulate those violent interreactions of weapon systems in combat.

One type of training involves gunnery ranges which utilize cloth targets with acoustic detection devices that can detect the supersonic airblast created as fired projectiles pass through the cone of detection. Since this cone of detection is approximately the same dimensions as the targets, an accurate count of each bit can be recorded. This reading is transmitted via radio to each pilot as a score after each target pass. Unfortunately, this type of training may involve some danger and in addition is extremely expensive.

As an alternative, laser gun simulator systems have been utilized in the training of combat troops. For example, the U.S. Army's "Multiple Integrated Laser Engagement System" (MILES) is made up of a series of lasers mounted on various infantry and motorized armor. Each type of weapon associated with a particular laser is pulse coded. Each person and weapon system is equipped with a series of laser detectors mounted, for example, on a lightweight belt. The belt or harness is worn by the man and attached by convenient securing means to the vehicles. Each type of system (man, tank, truck, etc.) has a code in its receiving system that will respond to a hit by a weapon of sufficient size to cause damage or destruction. If a weapon of smaller size is fired against such a target (such as M-16 rifle against a M-60 tank), no damage or kill response is generated by the receiver. Unfortunately, this type of system fails to provide complete safety of operation and in addition does not take into account various parameters of actual battlefield conditions, such as, for example, the trajectory of ammunition fired during simulation. Consequently, although effective to some degree, laser gun simulator systems of the past left much to be desired in providing the required accuracy and safety for adequate training.

SUMMARY OF THE INVENTION

The instant invention overcomes the problems encountered in the past by providing a laser gun simulator system which, although utilizing a laser, is completely eye safe as well as capable of incorporating therein trajectory, range, and approach angle information.

The gun simulator system of this invention is readily adaptable for use within conventional aircraft. The gun simulator system is easily mounted in a pod that would attach to an aircraft missile rail or other external mount. The laser gun utilized with the system of this invention is self-contained requiring only normal aircraft voltages for operation and a "fire" command input. When commanded by the pilot, the laser gun would "fire" for as long as a manual preset rounds available counter permitted, and at a rate consistent with real gun specifications. The entire system would be capable of being reset for further passes. Thus, gunnery practice could continue for as long as aircraft fuel and range time permitted.

The gun simulator system of this invention is made up of a laser as well as its associated electronics. The pulses emitted by the laser (or laser gun) are reflected from a target. In operation, the laser gun fires a first laser "round" made up of a plurality of pulses for determining range. That is, the plurality of laser "range" pulses are sent out in a "fanned" fashion at a preset angular displacement to the target. If a "range" pulse hits the target, the laser pulse is reflected and received by the airborne laser receiver. Actual range is calculated by a microprocessor within the system as a function of the round trip time it took that pulse to travel to the target and back to the receiver.

If the fired pulse is not received within a preselected period of time, the system registers "no hit". The firing continues until a "yes" answer is received, that is, a fired pulse has been returned to the receiver within the preselected period of time. This time period is analyzed by the conventional microprocessor within the simulator system in order to determine whether, in fact, the range was greater than 3,500 feet, less than 2,000 feet or between 3,500 feet and 2,000 feet.

If the range is between the latter (between 3,500 feet and 2,000 feet), appropriate ballistic information, which is also fed into the microprocessor, provides information which calculates the appropriate trajectory of a "bullet" for the particular range involved. This trajectory information is utilized in sending a signal to a beam deflector which allows for a subsequently fired "bullet" pulse to be emitted at the proper trajectory. The "bullet" pulse is also coded in such a manner so as to be recorded at the target as well as return a signal to the aircraft. If the returned "bullet" pulse is received by the receiver during the appropriate time interval, the simulator system of this invention records a "hit". If there is no reception, a "no" hit is recorded. The range information can be stored in the microprocessor each time the gun trigger is pressed. If required, the range can be stored for every bullet fired or every fifth bullet. The resolution of this type of storage will depend on the aircraft speed. For example, at 600 MPH if range is stored for every bullet fired, the range resolution will be approximately 10 feet and every fifth bullet will provide 50 feet resolution.

The gun simulator system of this invention can be utilized to realistically simulate air-to-ground strikes and air-to-air strikes. The targets are easily equipped with photodiode arrays and reflective material. By adding a non-pyrotechnique smoke charge to the target, an additional aircrew simulation is provided by actually seeing the target exhibit a type of visual cue associated with target damage when in fact struck by an appropriately coded "bullet" pulse.

In addition, the system of this invention can be easily made compatible with the Army's "Multiple Integrated Laser Engagement System." For each type of weapon, the associated laser is pulse coded and each person and target is equipped with a series of laser detectors mounted on a lightweight belt in the MILES concept. A code in the receiving system will respond to a hit by a weapon of sufficient size to cause damage or destruction.

It is therefore an object of this invention to provide a gun simulator system which is capable of producing accurate simulation based not only on range but also on ballistic trajectory.

It is a further object of this invention to provide a gun simulator system which is completely eyesafe.

It is another object of this invention to provide a gun simulator system which is readily adaptable for incorporation within an aircraft.

It is still a further object of this invention to provide a gun simulator system which is compatible with already existing gun simulator systems.

It is still another object of this invention to provide a gun simulator system which is economical to produce and which utilizes currently available components that lend themselves to standard mass producing manufacturing techniques.

For a better understanding of the present invention, together with other and further objects thereof, reference is made to the following description taken in conjunction with the accompanying drawing and its scope will be pointed out in the appended claims.

DETAILED DESCRIPTION OF THE DRAWING

DETAILED DESCRIPTION OF THE PREFERRED EMBODIMENT

Figure 1:
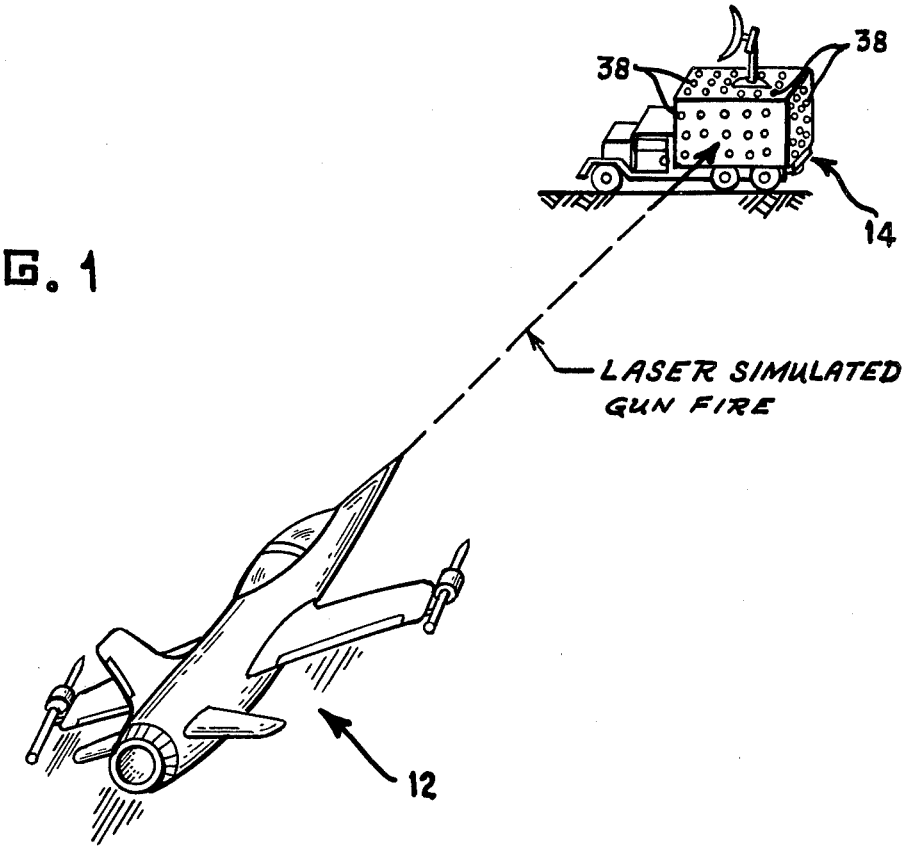
FIG. 1 is a pictorial representation of an aircraft utilizing the gun simulator system of this invention and approaching and firing at a ground target.

A pictorial representation of the operaton of the gun simulator system 10 is shown in FIG. 1 of the drawing where an aircraft 12 is depicted firing at a ground target 14.

Figure 2:
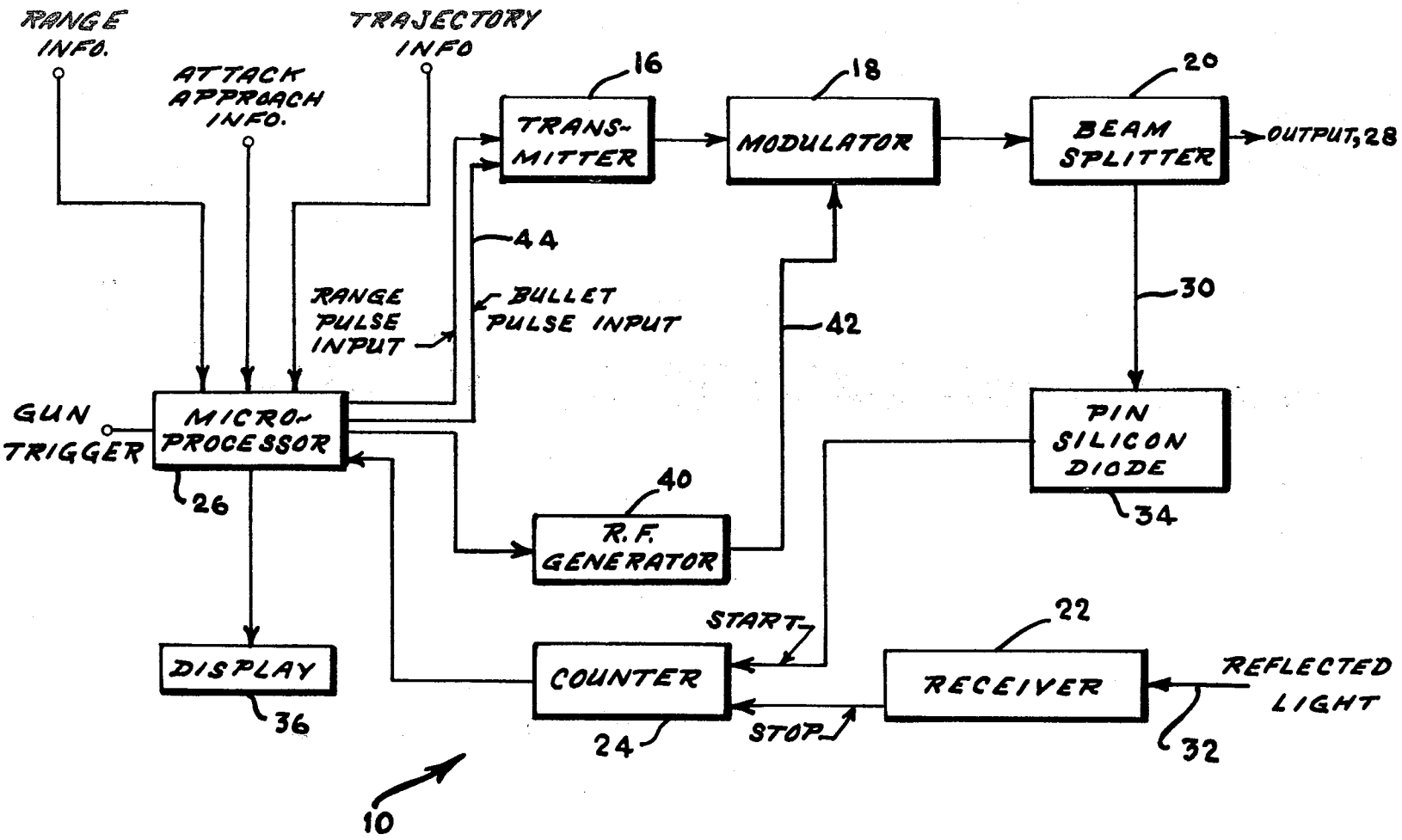
FIG. 2 is a schematic representation of the gun simulator system of this invention.

Reference is now made to FIG. 2 of the drawing, which represents in schematic fashion a block diagram of the gun simulator system 10 of this invention. The gun simulator system 10 is made up of six main components, (1) a transmitter 16, (2) a beam modulator 18, (3) a beam splitter 20, (4) a receiver 22, (5) a range counter 24, and (6) a microprocessor 26. In addition, a target 14 (shown in FIGS. 1 and 2 of the drawing) is utilized in conjunction with the gun simulator system 10 of this invention.

The gun simulator system 10 is readily adaptable for use within any conventional aircraft 12 or the like by being mounted in a pod (not shown) that would ordinarilly attach to the aircraft missile rail. If desired, simulator system 10 can be mounted on an external mount in which trigger inputs can be made available to fire transmitter 16. The transmitter 16 is self-contained and requires only normal aircraft voltages for operation and a "fire" command input. If desirable, a telescope could be mounted on transmitter 16 so that it can be easily boresighted.

For a clear and concise understanding of this invention the description set forth hereinbelow will set out with specificity the elements making up laser gun simulator system 10 of this invention.

Transmitter 16 is the form of a conventional laser with details thereof set forth hereinbelow. An essential consideration of the gun simulator system 10 of this invention is that the laser utilized within the invention be completely eye-safe. The Health, Education and Welfare (HEW) class criteria is defined by the Radiation Control Act of 1968, which sets the performance standards for the laser products. This standard is based around the amount of laser energy that the eye can withstand without damage. The Class I criteria is considered to be totally eyesafe even when the eye is continuously exposed for long periods.

According to the HEW standards, Class I acceptable emission limits for laser radiation is given hereinbelow.

For wavelength $>400$ nm but $\leqq 1400$ nm and emission duration $1.0\times10^{-9}$ sec to $2\times10^{5}$ sec, the Class I accessible radiation limit is given by:

$$R = 10K_1K_2t^{\frac{1}{4}}\text{Joules/CM}^2\text{/Sr}$$

where $k_1 = 10(\lambda - 700)/515)$ for 800 nm to 1060 nm
where $k_2 = 1$ for sampling internal $t \leqq 100$ sec.

Thus, the selection of an eye-safe laser (transmitter 16) will be based on the following five (5) factors:

1. The power level
2. The pulse duration
3. The repetition rate
4. The wavelength
5. The beam width Several different types of lasers will meet the above requirement. However, the GaAlAs laser is preferable with this invention due to its size, weight, simplicity of modulation, fast rise time, and cost. Secondly, the wavelength of the laser selected must be at a high quantum efficiency for the receiver selected.

GaAlAs lasers suitable for application with the gun simulator system 10 of this invention are available commercially from RCA, Laser Diode Lab etc. The fast rise time pulses are obtained by using an avalanche diode pulser for the laser. The pulser and laser integration unit is conventional and can be purchased commercially from American Laser Systems Inc., Meret, Power Technology, Inc., etc.

TYPICAL SPECIFICATIONS FOR TRANSMITTER 16

| Type of Laser | GaAlAs |
|---|---|
| Optical | |
| Peak Power | 5 watts |
| Wavelength | 840 nm ± 20 nm |
| Pulse width | 30 NS for range pulse<br>100 nm for "Bullet" Pulse |

-continued

| Type of Laser | GaAlAs |
|---|---|
| Beam Divergence | 10 MR with 25 mm EFL Optics<br>2.5 MR with 100 mm EFL Optics<br>1.3 MR with 200 mm EFL Optics |
| Boresight Telescope | 20X, Accuracy ± 0.5 Min. |
| Electrical | |
| Repetition Rate | 10 KHz |
| Risetime | 10 nsec or less |
| Digital Input | 10 KHz, 100 KΩ5v |
| Power Consumption | 2.5 watts |

Optically aligned with transmitter 16 is a beam deflecting means such as a conventional beam modulator 18 which is capable of establishing the initial beam direction and angle through which the laser pulses scan. In addition, modulator 18 establishes the "bullet" pulse direction in a manner to be described in detail hereinbelow.

Since mechanical modulators such as high speed gear drives are unacceptable with the instant invention, the appropriate modulator would be of the acousto-optical type. Such a modulator 18 scans pulses emanating from transmitter 16 by bending each beam of pulses over a preselected range of angles. The acousto-optical modulator 18 is made of an R.F. driver, a piezo-electric crystal and a beam deflector. The R.F. drive frequency is changed (50–150 MHz), which produces a variable space grating because of the change in the acoustic wavelength. The light is then defracted at a variable angle, which is a linear function of drive frequency. An instantaneous frequency change will cause a step in the beam position.

The resolution of an acousto-optic deflector is expressed in resolvable spots given by the equation:

$$N = \frac{\gamma f}{\alpha} + 1 = \frac{d}{v} \cdot \frac{\Delta f}{\alpha} + 1$$

where $\gamma$=Transmit time or flyback time.

$\Delta f$=Sweep range of R.F. drive signal.

$\alpha$=Constant determined by laser beam profile and the MTF required.

d=Laser beam dimension in the Bragg diffraction plane.

v=Acoustic velocity.

A typical acoustic-optic deflector fabricated from single crystal Tellurium dioxide ($TeO_2$) provides acoustic velocity 617 m/sec and for beam of 16.5×6 mm with $\Delta f$ of 50 MHz at center frequency 100 MHz gives 1000 spot resolution. A typical R.F. driver contains a varactor-tuned oscillator, a fast-acting digitally controlled R.F. switch, and a Class-A power amplifier. The oscillator features good tuning linearity and fast show rate. The R.F. switch is TTL compatible and its switching time (rise time) is usually 5 nsec. The acousto-optic beam deflectors of this type can be obtained from Isomate Inc. and Harris Corporation, etc., as a standard off-the-shelf device.

Acousto-optical modulator 18 is capable of operation with both the initial "range" pulses as well as the "bullet" pulse. When the gun trigger initiating the operation of the gun simulator system 10 of this invention is pushed, the laser may not be pointed to target 14. Hence, modulator 18 will scan vertically to locate the target. At 3500 ft., if aircraft 12 is positioned correctly, the laser pulse will miss the target approximately 21 ft. Thus, the angle the modulator has to scan is only 6 mR. However, a typical modulator will scan 50 mR. Thus, the ranging information can be obtained, even if the aircraft approach elevation is not correct for the bullet hit on the target.

Once the ranging information is obtained, microprocessor 26 will provide ballistic information in order to deflect the laser beam correctly for the bullet drop trajectory over a particular range.

TYPICAL SPECIFICATIONS FOR MODULATOR 18

| | |
|---|---|
| Optical | |
| Acoustic Medium | $TeO_2$ |
| Operation Wavelength | 400–1100 nm |
| OpticalTransmission | 70% Min |
| Laser Polarization | Random |
| Active Aperture | 4 mm × 50 mm |
| Scan Angle | ± 1.5 degrees (50 mR) |
| Scan Resolution | ± 1 min. |
| Electrical | |
| Tuning Characteristic | Linear freq. vs. Tuning Voltage<br>± 1% linearity |
| Tuning Voltage | + 4V to + 17V |
| Bandwidth f | 50 MHz |
| Access Time | 25 M Sec |
| R.F. Drive Power | 2.5 Watts |

A conventional beam divider such as beam splitter 20 is optically aligned with modulator 18 so as to allow substantially all of the energy from the pulses emitted from laser transmitter 16 to pass therethrough as output 28 in the form of "range" pulses and "bullet" pulses. A small portion 30 (approximately 3%) of the energy of the pulses are redirected and utilized for initiating the operation of counter 24 in a manner to be set forth in detail hereinbelow.

Receiver 22 which is utilized within gun simulator system 10 of this invention, detects the incoming pulses 32 which reflect off target 14. This receiver 22 can be of a variety of types of detectors, such as, for example, (1) a PIN silicon diode, (2) an avalanche silicon diode and (3) a photomultiplier.

The selection of the detector or receiver 22 utilized in the gun simulator system 10 of this invention depends upon the speed, sensitivity, quantum efficiency, size-weight restrictions, as well as cost. However, the important parameter that describes the performance of receiver 22 is the signal to noise ratio.

The signal power incident on receiver 22 can be given by equation:

$$S = \frac{4P_t T_t A_r T_r R_t}{R^2 (\theta_T)^2} e^{\rho R}$$

where $P_t$=peak power of the source, watts.

$T_t$=transmission through the transmitter (collimating) optics.

$A_r$=receiver aperture area, $m^2$ $T_r$=transmission through the receiver (collecting) optics.

R=transmitter to receiver range, m $\theta_T$=transmitter beam width, radians $R_t$=reflectance from the target $\rho$=atmospheric extinction coefficient, $km^{-1}$ It may be noted that using a reflective coating and target 14 at 30 degrees, a small percentage of power will be reflected back to receiver 22.

The noise consists of the receiver noise (N) caused by the detector dark current and post-detector thermal noise depends on the characteristic of the detector. The background (B), is also very important.

$$B \approx \frac{H_\lambda F_o \Omega_r A_r T_r}{R^2}$$

where
$H_\lambda$=background spectral irradiance
$F_o$=passband of the receiver filter
$\Omega_r$=receiver field of view
$A_r$=receiver aperture area
$T_r$=transmission through the receiver optics
R=transmitter to receiver range.

For error free operation of receiver 22, S>>B+N is required.

TYPICAL SPECIFICATION FOR RECEIVER 22

| Detective Type | APD/Photomultiplier |
|---|---|
| Optical | |
| Clear Aperture: | >4"Dia (8.1 × $10^{-3}$m$^2$) |
| Field of View: | 5-10 mR |
| Transmission through Optical System: | >50% |
| Optical band pass filter | 10 nm |
| Wavelength sensitivity | 800-900 nM |
| Electrical | |
| Rise time | <10 nsec |
| Bandwidth | >10 Mhz |
| Detector thermal noise | <10 × $10^{-24}$ A/Hz |

A range counter 24 is interposed between beam splitter 20 and receiver 22. During operation, beam splitter 20 directs a portion of each pulse 28 as pulse 30 to counter 24 in order to indicate the emission of output "range" pulses 28 of gun simulator system 10 of this invention. Pulse 30 is fed through a conventional PIN silicon diode 34 to range counter 24. The reflected signal 32 from receiver 22 is also fed into range counter 24, the operation of which is described hereinbelow.

Range counter 24 performs the time-range measurements using standard components and provides wide dynamic range (500–5000 feet distance) and high resolution and accuracy (±2 feet). Range counter 24 receives a start signal from PIN silicon diode 34 (or, if desired, microprocessor 26) when gun simulator system operation begins, at, for example, the activation of a trigger. During operation of simulator 10, receiver 22 will not receive return pulse 32 from target 14 if output "range" pulse 28 misses target 14 or if target 14 is out of the range of transmitter 16 (laser). This range is established by microprocessor 26 at a preselected distance of, for example, 5000 feet. For example, if the "range" pulse is fired every 100 micro seconds and receiver 22 fails to receive a return pulse within 10 micro seconds (100 laser pulses at 10 KHz rate), the time between a start and stop signal at counter 24, microprocessor 26 will store a "no hit." Any returned pulses 32 received by receiver 22 will provide time information by way of counter 24 to microprocessor 26. Microprocessor 26 will analyze the time information in terms of distance, that is, the time required to start and stop counter 24 will determine distances greater than 3,500 feet, 3,500 to 2,000 feet, and less than 2,000 feet.

In addition, microprocessor 26 can analyze a conventional ballistic trajectory information program in order to establish if, in fact, a "range" pulse would be a hit if the trajectory of the bullet were taken into account. However, under normal operating conditions, microprocessor 26 sends a signal to modulator 18 with the appropriate trajectory information and thereby directs a "bullet" pulse from the system at the appropriate trajectory in a manner more fully described hereinbelow.

Microprocessor 26 which performs the above procedures is conventional and can be easily obtained by the ordering of, for example, a 8080A microprocessor. Such a microprocessor 26 is capable of analyzing data in terms of range information and trajectory information with the number of "no hits" and "hits" stored and displayed in a conventional display 36, if desired. This display may be mounted in the cockpit of aircraft 12.

A conventional CPU, a self-contained, single board microprocessor 26 which includes the central processor, system clock, RAM and ROM memories with I/O lines can be used in this application. These types of units provide six general purpose 8-bit registers, an accumulator, a 16-bit program counter and a 16-bit stack pointer register. The 16-bit program counter allows direct addressing of up to 64 K bytes of memory. The stack pointer controls addressing of an external stack located anywhere within the read/right memory. This type of Board Level Computers (BLC) can be provided with up to 4 K bytes read only memory in increments of 1 k.

Target 14 is of any conventional design but must be compatible with transmitter 16 (laser) of gun simulator system 10 of this invention. Hence, the reflectors 38 (shown in FIG. 1 of the drawing) of target 14 in order to be receptive to the laser pulses 28 of a laser meeting the Class I criteria are preferred to have one inch to three inch diameter plastic reflectors as well as glass corner reflectors. Photodetectors (not shown) mounted on target 14 will react to only "bullet" pulses and trigger a small non-pyrotechnique light strobe unit. Therefore, as the aircrew fires at target 14 they will receive visual cueing from the target and/or target area indicating their simulator projectile impacts. These strobe units can be set at a cycle rate that would provide the most suitable pilot visually related mental response; that is necessary because if the light response is as rapid as the actual voltage rate (100/seconds) it will appear as a continuous light.

MODE OF OPERATION

In operation, a gun trigger operably attached to microprocessor 26 is pushed or otherwise activated in order to initiate the action of gun simulator system 10. This is the only input required for the system operation. A variety of conventional programs are introduced into a microprocessor 26. These programs provide microprocessor 26 with range information (a correlation between output and return pulse time and range), ballistic trajectory information, (a relationship between bullet trajectory and range), and the desired approach angle of aircraft 12 (10° or 30°).

Initially, microprocessor 26 provides an R.F. generator 40 a correct frequency based upon this approach angle. The output signal 42 of R.F. generator 40 activates modulator 18 accordingly and thereby sets the initial output angle for output pulses 28. The initial activation of microprocessor 26 also sends a signal to commence the firing of "range" pulses 28 from transmitter 16.

Figure 3:
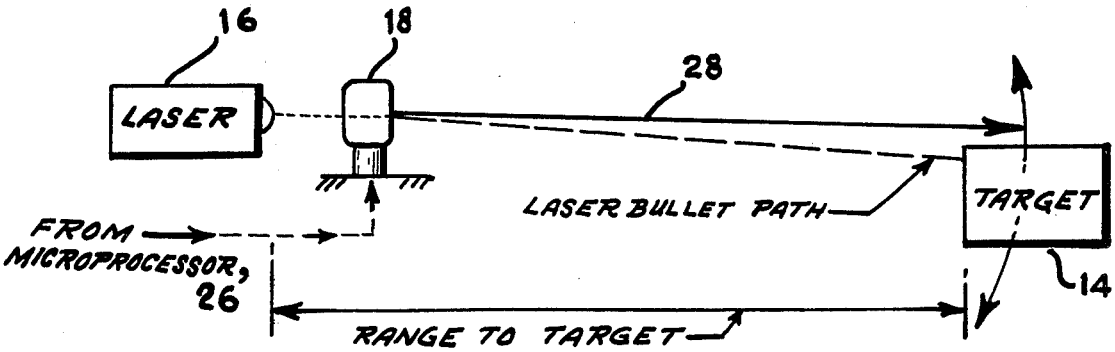
FIG. 3 is a schematic representation of the laser of the gun simulator system of this invention firing at a target.

As shown in FIG. 3 of the drawing the "range" pulses 28 are fired over a period of, for example, 10 msec (100 pulses) in a fan-like fashion. This scanning of pulses 28 is performed by modulator 18. In addition, each "range" pulse is utilized to start or reset range counter 24.

Beam splitter 20 placed in the optical path of the "range" pulses emanating from transmitter 16 provides a portion of the output pulse 28 as an input pulse 30 for each "range" pulse to PIN silicon photodiode 34 which starts counter 24. The range pulses 28 constitute the initial output of the gun simulator system 10 of this invention.

If a "range" pulse 28 is not returned or received by receiver 22 due to wrong approach (pulse did not hit target 14) or wrong range (greater than 5,000 feet), a "No" answer is recorded by microprocessor 26. Since 20 mm bullets are fired at a rate of 100 rounds per second through a Gatling gun there is a 10 msec time interval between two consecutive shots. In this time interval of the 10 ms, 100 laser "range" pulses 28 can be fired at a rate of 10 KHz. Thus, the laser "range" pulses will be fired at intervals of 100 msec., however, microprocessor 26 can be preset for any range distance. For the Class I laser, 5,000 feet preset distance appears appropriate.

If the returned "range" pulse 28 is not received by receiver 22 and there is no stop signal received by range counter 24 within 10 msec, the time required for a range pulse 28 to go 5,000 feet and back, range counter 24 will be waiting for another start pulse from PIN silicon diode 24. Hence, after 100 "No" answers from microprocessor 26 a "no hit" bullet has been fired.

If receiver 22 receives a "Yes" answer, that is, a returned "range" pulse 28 did in fact strike target 14 and returned to receiver 22, microprocessor 26 sorts out the range. If the range is greater than 3,500 feet or less than 2,000 feet once again a "no hit" is scored. However, if the range is between 3,500 feet and 2,000 feet, microprocessor 26 goes to the ballistic trajectory information program in order to obtain a correct bullet drop based on the range and approach angle. The appropriate R.F. frequency is sent to modulator 18 in order to set modulator 18 at the appropriate angle. At the same time, microprocessor 26 provides a "bullet" pulse signal 44 and transmitter 16 fires a "bullet" pulse at the appropriate angle. The "bullet" pulse resets counter 24 for a "bullet" pulse. If the "bullet" pulse hits target 14 and is received by receiver 22 within the appropriate time interval, microprocessor 26 scores a "hit". If the "bullet" pulse does not return a "no hit" is recorded by microprocessor 26. This information can be stored in microprocessor 26 for future display. The range information can be also stored in microprocessor 26 each time the gun trigger is pressed. If required, the range can be stored for every bullet fired or, for example, every fifth bullet. The resolution of this type of storage will depend on the aircraft speed. For example, at 600 MPH, if range is stored for every bullet fired the range resolution would be approximately 10 feet and every fifth bullet would provide 50 feet resolution.

As an alternative, microprocessor can in actuality make a comparison between range and trajectory of a "range" pulse and at that time determine whether or not a hit on target 14 has, in fact, been made. This can be accomplished without actually firing a "bullet" pulse. However, with such a determination the pilot would not be able to visually see on the ground a "hit" and would have to rely solely on microprocessor feedback.

By utilizing "bullet" pulses the system can be used to realistically simulate air-to-ground strike missions against live targets such as trucks, tanks, SAM AAA simulators, search radars, etc. Any ground target can be easily equipped with the photodiode array and reflective material. By adding a non-pyrotechnique smoke charge to the target, an additional aircrew stimulation is provided by actually seeing the target exhibit a type of visual tube associated with target damage.

In addition, the laser gun simulator system 10 of this invention can be easily made compatible with, for example, the Army's "Multiple Integrated Laser Engagement System." With such an arrangement, for each type of weapon, the associated laser is pulse coded and each person and weapon system is equipped with a series of laser detectors mounted on a lightweight belt within the concept. Each type of system has a code in its receiving system that would respond to a hit by a weapon of sufficient size to cause damage or destruction. For example, if a weapon of smaller size is fired against it, no damage or kill response is generated by receiver 22.

Although this invention has been described with reference to a particular embodiment, it will be understood to those skilled in the art that this invention is also capable of a variety of alternate embodiments within the spirit and scope of the appended claims.

I claim:

1. A gun simulator system comprising a source of electromagnetic radiation energy at a first location for transmitting a plurality of electromagnetic pulses, a target at a second location, means optically aligned with said plurality of pulses for continually varying the angle of output of said pulses, means optically aligned with said plurality of pulses for directing a substantial portion of all of said electromagnetic radiation of each of said pulses in the direction of said target and the remainder of said electromagnetic radiation of each of said pulses in another direction indicative of the start of each of said pulses, means on said target for reflecting said pulses, means optically aligned with said target for receiving said reflected pulses, computer means operably connected between said electromagnetic source and said receiving means for comparing the time interval between the start of each of said pulses and the reception of the same pulse in order to determine whether said pulse is received within a preselected time interval thereby establishing range information and for comparing said range information with preselected trajectory information corresponding to said range information, whereby the output of said computer means provides a signal indicative of whether the output of said gun fired at said target would strike said target.

2. A gun simulator system as defined in claim 1 wherein said computer means provides a first signal indicative of one of said pulses being received by said receiving means and a second signal indicative of said trajectory information, said electromagnetic radiation source receiving said first signal and emitting a distinct pulse of electromagnetic radiation, and said output angle varying means receiving said second signal and establishing the angle of output of said distinct pulse in accordance therewith.

3. A gun simulator system as defined in claim 2 wherein said electromagnetic radiation source is a laser and said emitted pulses of radiation are eyesafe.

4. A gun simulator system as defined in claim 3 wherein said output angle varying means is an acousto-optical modulator.

5. A gun simulator system as defined in claim 4 wherein electromagnetic energy directing means is a beam splitter.

6. A gun simulator system as defined in claim 5 wherein said reflecting means on said target provides a signal when struck only by a preselected one of said distinct pulses.

7. A gun simulator system as defined in claim 6 wherein said remainder of said electromagnetic radiation of each of said pulses indicative of the start of each of said pulses amounts to approximately 3% of all of said electromagnetic radiation of each of said pulses.

* * * * *